US006554066B2

(12) United States Patent
Lopes et al.

(10) Patent No.: US 6,554,066 B2
(45) Date of Patent: Apr. 29, 2003

(54) GAS SEPARATOR WITH AUTOMATIC LEVEL CONTROL

(75) Inventors: Divonsir Lopes, Rio de Janeiro (BR); Robson de Oliveira Souza, Rio de Janeiro (BR); Rogerio Floriao Soares, Rio de Janeiro (BR)

(73) Assignee: Petroleo Brasileiro S.A.-Petrobras (BR)

( * ) Notice: Subject to any disclaimer, the term of this patent is extended or adjusted under 35 U.S.C. 154(b) by 0 days.

(21) Appl. No.: 09/768,009

(22) Filed: Jan. 24, 2001

(65) Prior Publication Data

US 2002/0023750 A1 Feb. 28, 2002

(30) Foreign Application Priority Data

Jan. 27, 2000 (BR) ..... PI 0000183

(51) Int. Cl.[7] ..... E21B 43/34
(52) U.S. Cl. ..... 166/265; 166/105.5
(58) Field of Search ..... 166/265, 105.5, 166/266, 268, 263, 305.1, 105, 105.6

(56) References Cited

U.S. PATENT DOCUMENTS

| | | | | |
|---|---|---|---|---|
| 2,491,587 A | | 12/1949 | Seago | |
| 3,128,719 A | * | 4/1964 | Jongbloed et al. | 166/105.5 |
| 3,451,477 A | | 6/1969 | Kelley | |
| 3,485,300 A | * | 12/1969 | Engle | 166/265 |
| 3,791,444 A | * | 2/1974 | Hickey | 166/105.5 |
| 4,023,941 A | | 5/1977 | Miller | |
| 4,531,584 A | | 7/1985 | Ward | |
| 4,762,176 A | | 8/1988 | Miller | |
| 4,981,175 A | | 1/1991 | Powers | |
| 5,309,998 A | | 5/1994 | Rivas et al. | |
| 5,333,684 A | * | 8/1994 | Walter et al. | 166/105.5 |
| 5,431,228 A | | 7/1995 | Weingarten et al. | |
| 5,482,117 A | | 1/1996 | Kolpak et al. | |
| 5,525,146 A | | 6/1996 | Straub | |
| 5,715,890 A | | 2/1998 | Nolen | |
| 6,036,749 A | | 3/2000 | Ribeiro | |
| 6,085,836 A | | 7/2000 | Burris | |
| 6,116,338 A | | 9/2000 | Morrison | |
| 6,155,345 A | | 12/2000 | Lee | |
| 6,179,054 B1 | | 1/2001 | Stewart | |
| 6,234,248 B1 | | 5/2001 | Knight | |
| 6,277,286 B1 | | 8/2001 | Søntvedt | |

OTHER PUBLICATIONS

Lopes; Application No. 09/730,735 filed Dec. 20, 1999.

* cited by examiner

*Primary Examiner*—David Bagnell
*Assistant Examiner*—Jennifer R. Dougherty
(74) *Attorney, Agent, or Firm*—Nixon & Vanderhye PC

(57) ABSTRACT

This relates to a gas separator (8) of the cascade type, with stratified or non-stratified flow, equipped with automatic level control to perform a process of the gravitational separation of two immiscible fluids of different densities, particularly to separate the gaseous phase from a two-phase mixture (liquid and gas). It is installed at the bottom of an oil well, upstream from a lifting pump (12) in order to minimize the entry of gas into pump (12). The level control system comprises a valve (29), a spring (30) and a packer (26). It is based on the combined effects of the abovementioned components (26, 29, 30), the gas pressure on the region of perforated casing (10) and the thrust exerted on a settling vessel (3) by the liquid on which it floats. The separator according to the invention has a control system for the level of the liquid stored in settling vessel (3) mounted within its separator (8), ensuring flow of the mixture which is ideal for the occurrence of gas separation.

22 Claims, 6 Drawing Sheets

GAS SEPARATOR WITH AUTOMATIC LEVEL CONTROL

SCOPE OF THE INVENTION

The present invention relates generally to the field of petroleum production.

The invention particularly includes equipment for effecting a process for the gravitational separation of immiscible fluids of different density.

More particularly, it relates to equipment capable of efficiently separating the gaseous phase from a mixture of liquid and gas, the equipment being provided internally with an automatic level control system. Preferably, the equipment is used at the bottom of oil wells which bring oil to the surface through the use of lifting pumps.

A separator of this kind may also be used at the surface.

It may find application in the petrochemical, chemical or other industries.

BASIS OF THE INVENTION

In nature, petroleum is generally found mixed with water and gas.

In wells where there is no natural lift one of the alternatives available for lifting the petroleum from the well bottom to the surface is to use lifting pumps. Pumping may be of the sucker rod pumping (SRP) type, progressive cavity type (PCP), electrical submersible pumping (ESP) type or, where seabottom Christmas trees are used, of the subsea electrical submersible pumping (ESP in wet Christmas tree) type. Whatever type of pumping is selected, the presence of free gas above a certain percentage in the liquid mixture being pumped will cause a significant loss of efficiency in the pumping process.

To increase pumping efficiency it is common for separators for separating gas from the liquid mixture to be installed at the bottom of an oil well. There are various types of separators for this purpose available at the present time but, nevertheless, conventional separators, which largely use bubbling separation, generally have a lower separating efficiency than is desirable.

Separators based on other effects, such as e.g. the cascade flow type, stratified type, Jukovski effect type, etc. generally offer greater efficiency. However, these separators depend on the level of liquid within them being maintained within a specified range. This requires the use of an external manual or automatic control system based on sensors, valves and links between them, which are vulnerable points and add complexity to the system.

STATE OF THE ART

The fact that free gas reduces the efficiency of oil-well pumping systems is widely known. The first patent for a separator, to reduce the quantity of free gas at the inlet to a well-bottom pump, was published in 1881. Since then, many other separators have been proposed but, depending on operational conditions, the use of known separators has not always resulted in good pumping efficiency.

The process most commonly adopted in conventional well-bottom gas separators currently in use consists of adding a two-phase mixture to a medium in which the continuous phase present is liquid. Under these conditions gas is compelled to bubble in the direction of the dynamic level of the well and separation is subject to the rate of rise of bubbles through the liquid which, according to Stokes Law, is inversely proportional to the viscosity of the liquid.

The present applicant has lodged a patent application in Brazil (Application No. PI 9905912.6) entitled "Well Bottom Gas Separator" relating to a new design of separator based on flow of the cascade type, which might or might not be followed by flow of the segregated or stratified type. In this separator the two-phase mixture enters a settling vessel through openings located in the upper part of its side surface, above the level of the liquid which has accumulated in the separator. Thus, unlike the previous conventional separators in use at the time, the mixture is injected in a region where gas is the continuous phase present and separation takes place very much more rapidly than in a medium where the continuous phase is liquid. In order to optimize separation conditions, converting chaotic vertical cascade type flow into an inclined and segregated flow, a component of helicoidal shape was located within the settling vessel occupying a space above the level of liquid in the separator. To avoid turbulence and flooding, among other reasons, the pitch of the helicoidal surface was made to be variable so as to control the speed and thickness of the liquid layer over the helicoidal surface.

In general wells begin production with a high static level, and even in the case of separators of the cascade type separation initially takes place by bubbling. In order to ensure a changeover from this type of separation to cascade type separation the level of liquid within the settling vessel has to be lowered. This can be achieved by fitting a choke valve in the gas line for example, which has to be kept closed until the level of liquid in the settling vessel lies within a selected range. Thus, when the well is started, this choke valve must be kept closed as long as the level of the mixture is above the specified level and must be kept open when the level of liquid in the separator varies within the specified range.

Maximum pumping of liquid is achieved when the level of the mixture is stabilized in the settling vessel within the selected range, with the choke valve fully open. If the level only becomes stabilized when the choke valve is partly closed, output falls because the well casing, which is pressurized with gas, applies a back-pressure against the producing rock. Also, if the valve is open to eliminate the back-pressure from the gas, output can be even less still because the back-pressure of the gas is replaced by an even greater back-pressure from the liquid and under these conditions the level of liquid in the separator will rise well above the region of the openings and the cascade effect will cease to occur. As the efficiency of separation by bubbling is less than that of cascade separation, there is an adverse effect on the efficiency of pumping.

As manual control of the level of liquid within the cascade or cascade/segregated separator is burdensome, it is recommended that automatic level control should be used. This can be achieved, e.g., using a control valve in the gas line and level sensors within the well.

The volumetric flow from the pump downstream of the separator is normally constant. Nevertheless, depending on the type of two-phase flow, the flow of liquid upstream of the separator can vary. Slug flow can result in very great changes in the level within the separator, mainly when the area of the annulus in the separator is small. A long separator, which permits considerable variations in level, apart from being difficult to construct and install, has the disadvantage that it reduces production from the well by causing back-pressure against the producing rock as a result of an excessive hydrostatic column extending from the perforated casing to the top of the separator.

A level control valve located in the gas outlet at the wellhead prevents excessive variation in the level of liquid in the separator. Nevertheless level sensors are required at the bottom of the well, resulting in an expensive installation of limited reliability.

U.S. Pat. No. 3,451,477 discloses a system for direct control of the level in a well using a valve with two stages; a principal and a secondary stage, which has the advantage of being easily operated when there is a blockage due to differential pressure. The design of this valve apparently avoids gas entering the lifting pump. In reality this system does not prevent a considerable quantity of gas from entering the pump because the valve, when closed, maintains the volume of liquid in the separator but does not maintain the flow of liquid in the pump constant, and due to this the flow of gas in the pump increases to compensate for the lack of liquid. When the flow of gas in the separator falls, there is increased gas flow in the pump because the gas expands as it passes through the valve, due to the fact that the pressure on the suction side of the pump is less than the pressure in the separator. It is therefore concluded that the control system used in this separator cannot function adequately.

Like the abovementioned patent, the purpose of this invention is to control the level of liquid in the separator directly, eliminating the need for a control system at the surface and a level sensor at the bottom of the well, sending signals to the surface. For this, the separator according to the invention has its own mechanical components forming an automatic control system for controlling the level of liquid within the separator, bringing about a reduction in the height of the equipment and guaranteeing flow of the cascade type, or cascade and segregated types, within the separator.

SUMMARY OF THE INVENTION

The present invention relates to a gas separator of the cascade type, equipped with level control, for installation, preferably, at the bottom of an oil well, upstream from a lifting pump, with the purpose of minimizing the entry of gas into the pump and, consequently, maximizing the volumetric efficiency of pumping.

The present invention accordingly provides a separator with automatic level control to separate the gaseous phase from a two-phase liquid and gas mixture, said separator being capable of being provided at the bottom of a well provided with means for lifting liquid by pumping, said separator comprising:

- a settling vessel having a fluid entrance part in the upper portion of its side surface and which is moveable in the vertical direction;
- a packer (plug) positioned above the settling vessel;
- a valve arranged to control the passage of gas from the lower side of said packer to the upper side, said valve being connected to said settling vessel such that vertical movement of said settling vessel actuates said valve.

Further, the invention provides a method of separating liquid and gas from a two-phase mixture, said method comprising:

- supporting a settling vessel on a body of fluid;
- allowing said two phase fluid to enter said settling vessel at its top so as to produce a cascade of fluid; thereby separating the liquid and gas phases;
- collecting said separated liquid in said settling vessel;
- regulating the flow of separated gas using a variable valve;
- pumping said separated liquid from said settling vessel;
- opening and closing off said valve in accordance with the vertical position of said settling vessel.

The fluid originating from the producing rock, a mixture of liquid and gas, ascends through the annulus between the separator and the well casing to enter a settling vessel, which forms an integral part of the separator, through openings located in the upper portion of the side surface of the vessel. As the fluid flows horizontally from this annulus to the interior of the settling vessel, the horizontal component of the movement perpendicular to the gravitational field promotes part of the separation. The other part takes place within the settling vessel, by flow which is favourable to separation: flow of the cascade type, which may or may not be followed by flow of the segregated type. Segregated type flow occurs when there are helical members within the settling vessel or when the well is directional, that is when the flow takes place over an inclined and descending surface. The gas separated in this way passes through a valve and rises through the annulus in the well up to the surface. The liquid passes through the suction tubing, the pump and the production column, reaching the surface.

The invention offers high efficiency because it intrinsically possesses an automatic system for controlling the level of the liquid held in the settling vessel, ensuring ideal flow for gas separation.

BRIEF DESCRIPTION OF THE DRAWINGS

The present invention will be described by way of example only, with reference to the accompanying drawings in which.

DETAILED DESCRIPTION OF THE INVENTION

For a better understanding of the invention it will now be described with reference to the figures accompanying this description. It should however be pointed out that the figures illustrate only one preferred embodiment of the invention, and are not therefore of a restrictive nature. In accordance with the concept of the invention described below, the possibility of using different arrangements or supplementary devices, a fact which will be included within the scope of the invention, will be clear to those skilled in the art.

Figure 1:
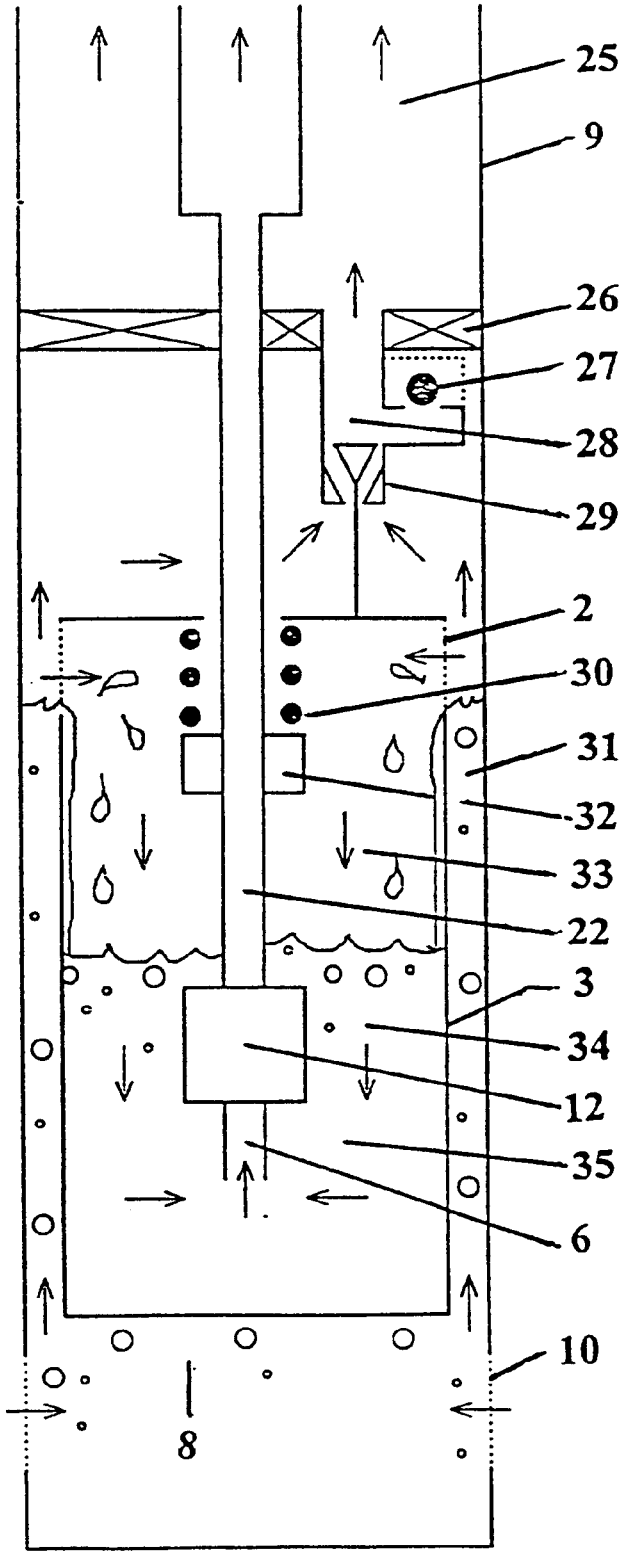
FIG. 1 shows a schematic longitudinal cross section through the gas separator according to the present invention.

FIG. 1 shows a gas separator (8) according to the invention, of the cascade type, without helicoidal members, equipped with a level control. This is shown installed in the bottom of a well, upstream from a lifting pump (12), for the purpose of minimizing gas entry into that pump (12) and consequently maximizing the volumetric efficiency of pumping. The well is represented as being bounded by its casing (9). The region in which the separator (8) is installed is isolated from the upper part of the well by means of a packer (26).

The pump may be of any suitable type, e.g. sucker rod, progressive cavity, electrical submersible or subsea electrical submersible.

Separator (8) basically comprises a settling vessel (3) where the greater part of the separation between the gas phase mixed with the liquid phase takes place. The automatic level control system, which is designed to permit adjustment and maintenance of an adequate level of liquid within settling vessel (3) can be seen among the other components in FIG. 1, and comprises:

- a pipe for the exit of gas (28), connecting the outlet from a valve (29) with the annulus (25) of the well,
- a valve (29), mentioned above, which opens in accordance with the varying depth of settling vessel (3) which in turn depends on the level of liquid in vessel (3),
- a one-way valve (27) located in said pipe (28) for the exit of gas, and
- a spring (30), e.g. a helicoidal spring, supported between settling vessel (3) and a connection (32), e.g. a sleeve, to production column (22) within that vessel (3).

Packer (26) mentioned, which isolates the bottom region where the separator is installed from the remainder of the well, is designed to cause the gas to pass through a control valve (29) when this moves towards the surface.

A lifting pump (12) is connected to production column (22) by means of e.g. a sleeve (32) which in this embodiment also serves as a lower support for an elastic medium, e.g. a helicoidal spring (30), which supplements the level control system. Said spring (30) encloses production tubing (22) and is supported between said sleeve (32) and the top of settling vessel (3).

The function of the spring is to provide a variable longitudinal supporting force to the settling vessel (3). As such, it could be located elsewhere such as between the bottom of the vessel (3) and the bottom of the casing (9).

It can be seen in FIG. 1 that settling vessel (3) floats on the liquid which accumulates at the bottom of the well. The equilibrium position is that which results from the intrinsic weight of vessel (3) and the liquid which has accumulated in it, which acts downwards, and by the reaction of spring (30) and the thrust of the liquid against settling vessel (3), which act upwards. It will also be seen that when settling vessel (3) tends to sink, control valve (29) tends to close, and when settling vessel (3) tends to rise, said valve (29) will tend to open.

The fluid originating from the producing rock, mixed liquid and gas, ascends through annulus (31) between separator (8) and well casing (9) and enters settling vessel (3) through opening (2) present in the upper side surface of that vessel (3). As fluid flows through said annulus (31) in an upward direction, against the gravitational field, from the region of the perforated casing (10) to entry openings (2) to settling vessel (3), virtually no gas separation occurs. As the fluid flows from annulus (31) between separator (8) and casing (9) into settling vessel (3) the horizontal component of the movement perpendicular to the gravitational field causes one part of the separation. The other part takes place within annulus (33) between the inner side surface of settling vessel (3) and production tubing (22) where flow of the cascade type occurs. The gas separated rises through the annulus in the well (25) to the surface, passing through control valve (29). The liquid rises through suction tubing (6), passes through pump (12) and reaches the surface via production column (22).

Openings (2) in the upper side surface part of settling vessel (3) have diameters and a distribution such that the flow of fluids per unit length of the perforated vessel is made small. The intention is not to carry the gas which is within annulus (31) between separator (8) and well casing (9) into vessel (3) and, in particular, not to cause flooding of liquid within annulus (33) between the inner side surface of settling vessel (3) and production column (22) where the initial descending velocity of the liquid is low. On the other hand the diameter of openings (2) should be large enough so as not to cause clogging by sand or detritus.

As the quantity of accumulated liquid increases, settling vessel (3) moves downwards through the action of the weight of the liquid, which is greater than the sum of the thrust received from the liquid outside settling vessel (3) and the action of spring (30). This has the result that control valve (29) closes, preventing the exit of gas and increasing pressure in the vicinity of the perforated casing. The entry of fluids into the well is then reduced and the pressure in the suction piping (6) from lifting pump (12) increases, increasing the flow and reducing the quantity of free gas in pump (12).

The opposite happens when the quantity of liquid which has accumulated in settling vessel (3) decreases. Control valve (29) opens when settling vessel (3) rises as a result of the effect of the thrust of the outside liquid and the force of spring (30) being greater than the weight of the liquid in vessel (3). Thus the pressure in the vicinity of the perforated casing (10) decreases, which increases the flow of fluids originating from the producing rock; the flow from pump (12) falls because the pressure in suction piping (6) falls and the quantity of free gas increases. The quantity of liquid in settling vessel (3) increases, with the result that the latter returns to the equilibrium position.

To sum up, various phenomena contribute to maintaining a predetermined liquid level within settling vessel (3), guaranteeing adequate flow of the cascade type.

The one-way valve (27), e.g. a check valve, positioned in gas outlet pipe (28) which links control valve (29) to packer (26), makes it possible to pump make-up fluid or oil through annulus (25) of the well when it is started up, independently of the opening of control valve (29). In addition to this it eliminates the downward pressure difference in control valve (29), which could keep it undesirably closed.

Unlike the separator disclosed in U.S. Pat. No. 3,451,477 mentioned above, in this invention there is no need for a valve with stages, and therefore an upward pressure difference assists the opening of control valve (29) instead of opposing it.

To increase separation efficiency the diameter of settling vessel (3) should be maximized to prevent the liquid from exceeding an optimum level and to reduce the rate of flow below that level. In addition to this, it should be the same size as or less than the passage diameter (drift) of the casing (9) and should be fishable (i.e. able to be withdrawn from the well bottom).

As for the dimensioning of suction tubing (6), it must be borne in mind on the one hand that this must have a sufficiently small outside diameter to maximize the transverse cross section of flow into settling vessel (3) and on the other hand should have a sufficiently large inside diameter not to cause excessive loss of pressure. Loss of head in suction tubing (6) reduces pressure in the vicinity of the inlet to lifting pump (12), causing release and expansion of gas and consequently reducing pumping efficiency. The length of suction tubing (6) should be as short as possible to minimize the loss of head within it and to ensure that separator (8) is not unnecessarily long. Also, all the flow transition should take place along this length from the small annulus (34) between pump (12) and the inner side surface of settling vessel (3) to the large annulus (35) between suction tubing (6) and the inner side surface of settling vessel (3), or, that is, suction tubing (6) should be sufficiently long for lifting pump (12) not to interfere with the stabilized two-phase descending flow in the vicinity of the lower end of suction tubing (6).

In general all the parts should be of a minimum necessary thickness to maximize the internal volume of separator (8).

The cascade type separator as described above can separate large quantities of gas from liquid in the upper region of settling vessel (3), above the level of liquid, where the liquid descends in droplets or gushes. However, the liquid descends rapidly, either in free fall or flowing along the walls, reducing the possibilities for gas to be released from the liquid. In addition to this, the violent impact of the descending liquid against the liquid which has accumulated in settling vessel (3) can cause gas to be reincorporated with the liquid. In the upper region the mean flow of gas is low, the same as the flow of gas which will be delivered to lifting pump (12). The region of settling vessel (3) with liquid can be expanded by a certain amount to the detriment of the region containing gas, with negligible harm.

For the above reasons the invention provides for the fitting of a helicoidal member or members within settling vessel (3) to occupy the space above the level of liquid. The helicoidal member transforms the vertical and chaotic descending flow into inclined and segregated flow.

To avoid turbulence and flooding, the pitch of the initial length of the helicoidal member should be infinite so that as flow over the said helicoidal length begins it is tangential to the direction in which the fluid is falling. As the liquid descends, the pitch of the helicoidal member reduces until it reaches a value such that it:

- maximizes the centrifugal force, which sums vectorially with the gravitational force, improving separation,
- minimizes turbulence,
- maintains a minimum thickness of liquid on the helicoidal member, minimizing the time required for gas bubbles to rise through that thickness.

If the velocity of the liquid in the helicoidal member as it approaches the level of liquid is high or sufficient to cause reincorporation of gas as a result of a hydraulic back-wash, the pitch of the helicoidal member should be reduced so that the velocity with which the liquid enters is gradually reduced.

Figure 2:
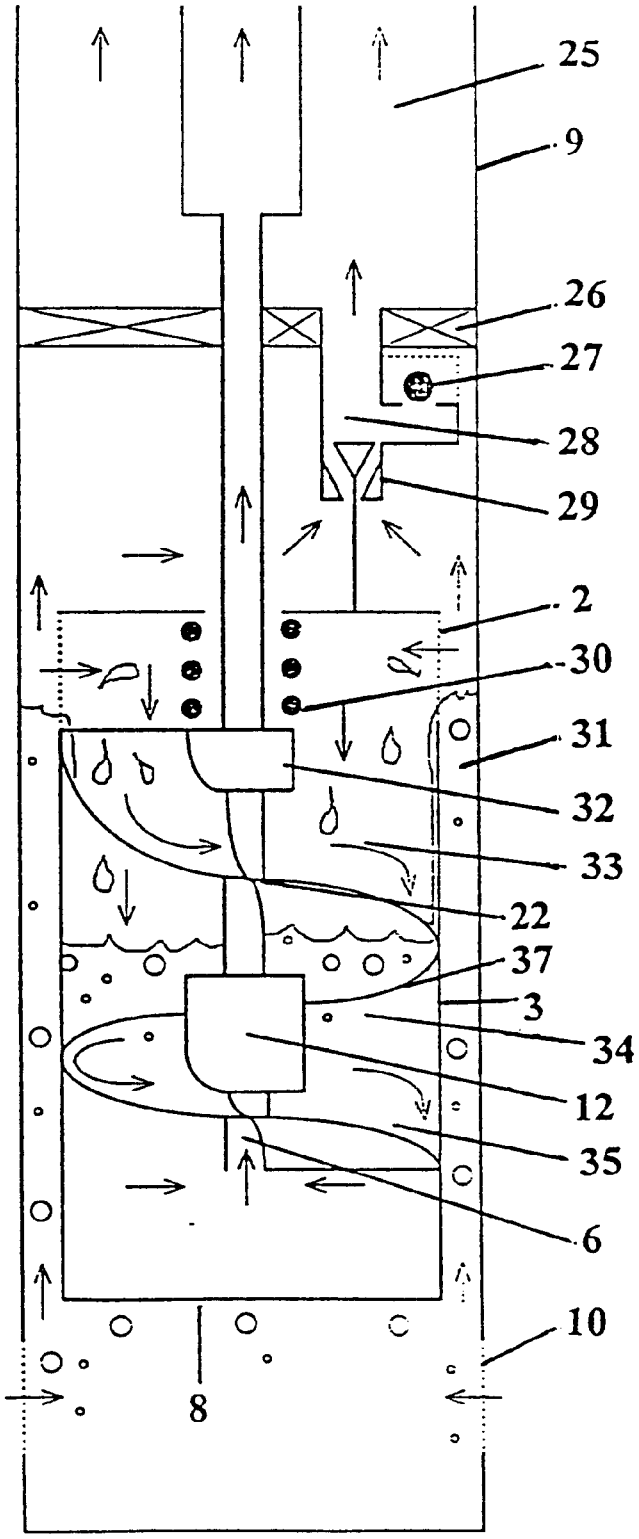
FIG. 2 shows a schematic longitudinal cross section through the gas separator according to the present invention having a single helicoidal member.
Figure 3:
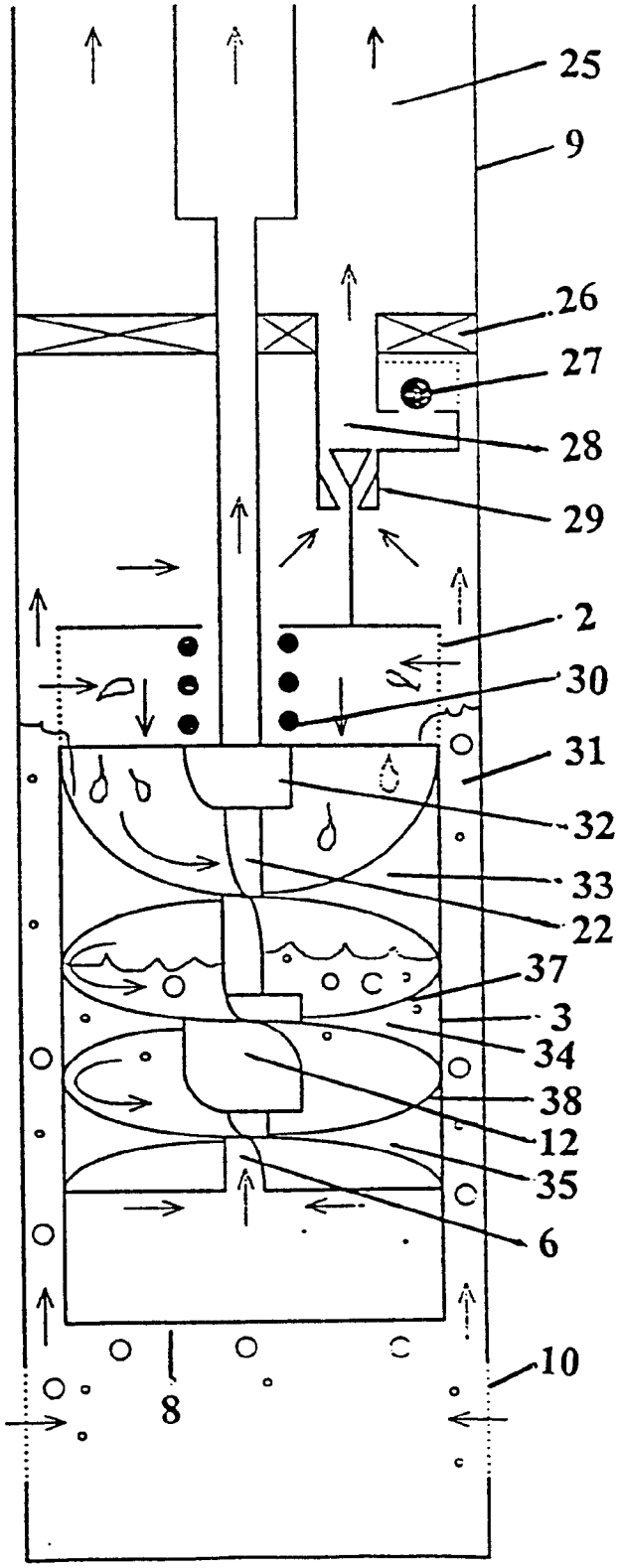
FIG. 3 shows a schematic longitudinal cross section through another gas separator according to the present invention having two helicoidal members.

FIGS. 2 and 3 show two separators of the same type as that illustrated in FIG. 1, but equipped with one helicoidal member (37) and two helicoidal members (37,38) respectively. The number of helicoidal members may be greater than two, and in this case it is convenient that they should be uniformly spaced around the circumference of settling vessel (3). The use of more than one helicoidal surface tends to offer better performance because the flow of liquid is divided, and as a consequence the thickness of liquid on each helicoidal member decreases, reducing the time necessary for separation, or, that is, reducing the time taken by gas bubbles to ascend through those thicknesses. Each helicoidal member functions as a parallel separator, with the result that in comparison with other more complex separators, like that in U.S. Pat. No. 5,389,128, the invention has an additional advantage in that it does not have many moving parts.

Figure 4:
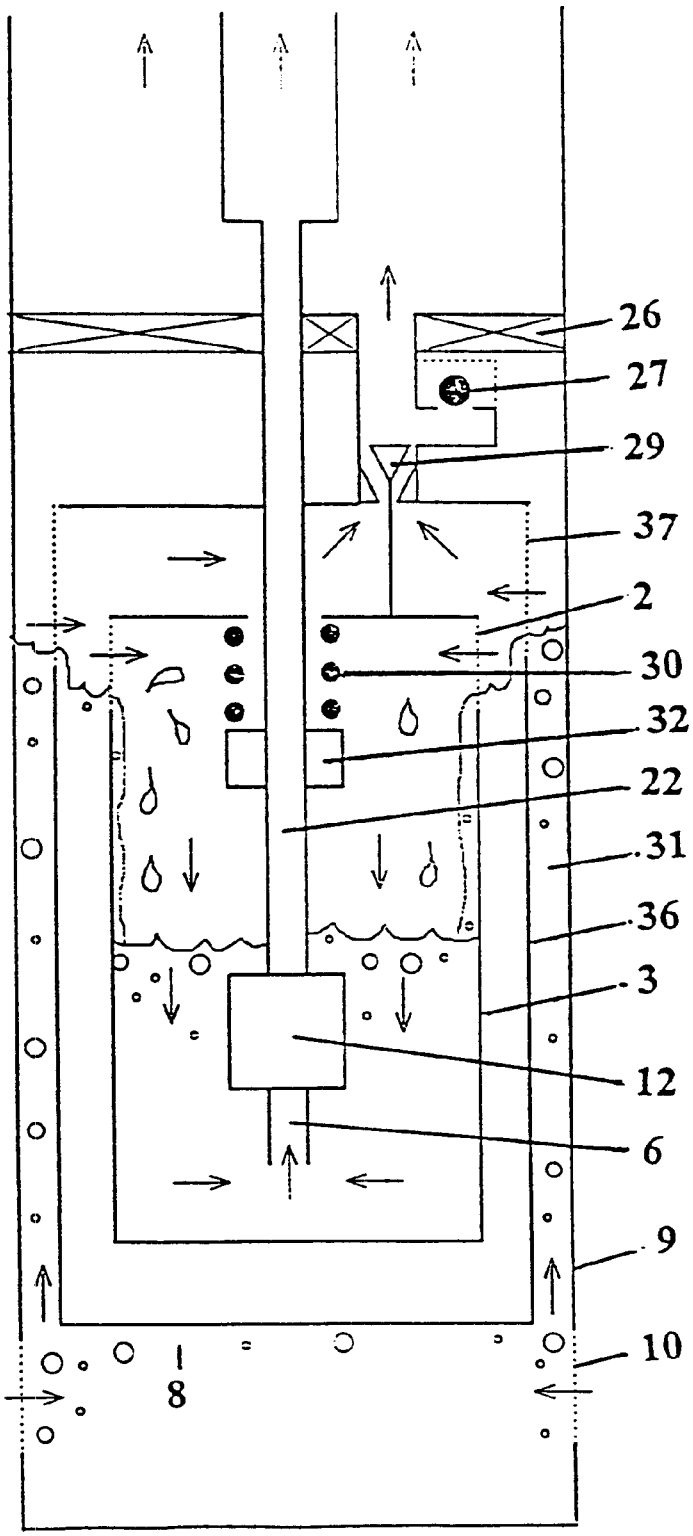
FIG. 4 shows a schematic longitudinal cross section through the gas separator according to the present invention with a double settling vessel.

The selection of spring (30) in the level control system may be imprecise when there is no good assessment of the density of the two-phase mixture which encloses settling vessel (3), and as a consequence there is no good assessment of the thrust on that vessel (3). To resolve this problem a separator in which the thrust against settling vessel (3) is provided by a single phase liquid, as shown in FIG. 4, is proposed. This is a separator similar to that described above, but which also has a fixed vessel (36) containing single phase liquid surrounding settling vessel (3). In this description this separator will be referred to as a "separator with a double settling vessel".

The two-phase mixture originating from the producing rock rises through annulus (31) between well casing (9) and the vessel (36) containing single phase liquid which surrounds settling vessel (3), passes through openings (37) present in the upper side portion of said enclosing vessel (36) and through the openings (2) in the upper side portion of settling vessel (3), and enters the vessel (3), where separation takes place in an identical way to that in the concept described previously, based on a single settling vessel. The vessel (36) which surrounds settling vessel (3) is full of an easily obtained denser liquid, normally water, whose density and thrust are well known, thus making it easier to select spring (30) for the level control system.

The separator of the cascade type with level control and a double settling vessel also has the advantage that surrounding vessel (36) protects and assists the movement of settling vessel (3).

Figure 5:
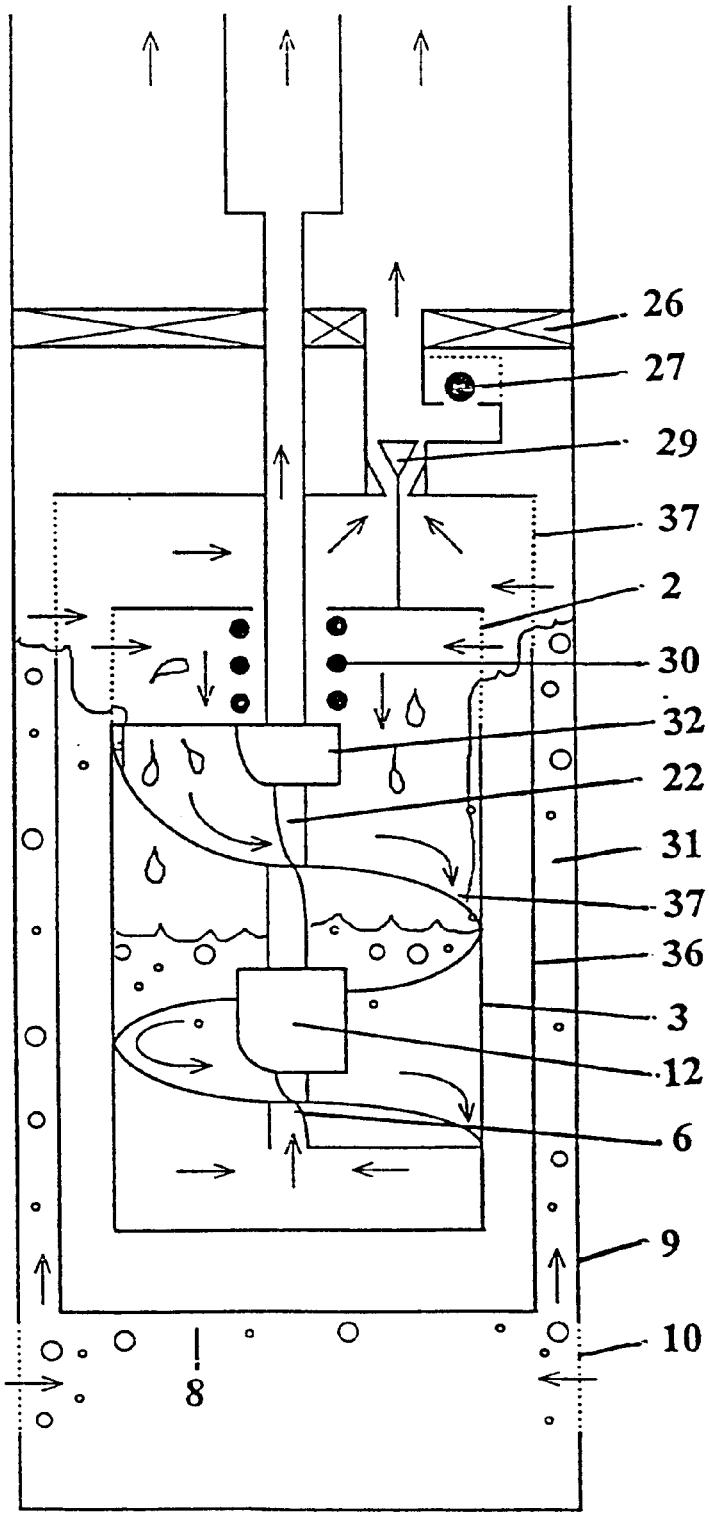
FIG. 5 shows a schematic longitudinal cross section through the gas separator according to the present invention with one helicoidal member and a double settling vessel.
Figure 6:
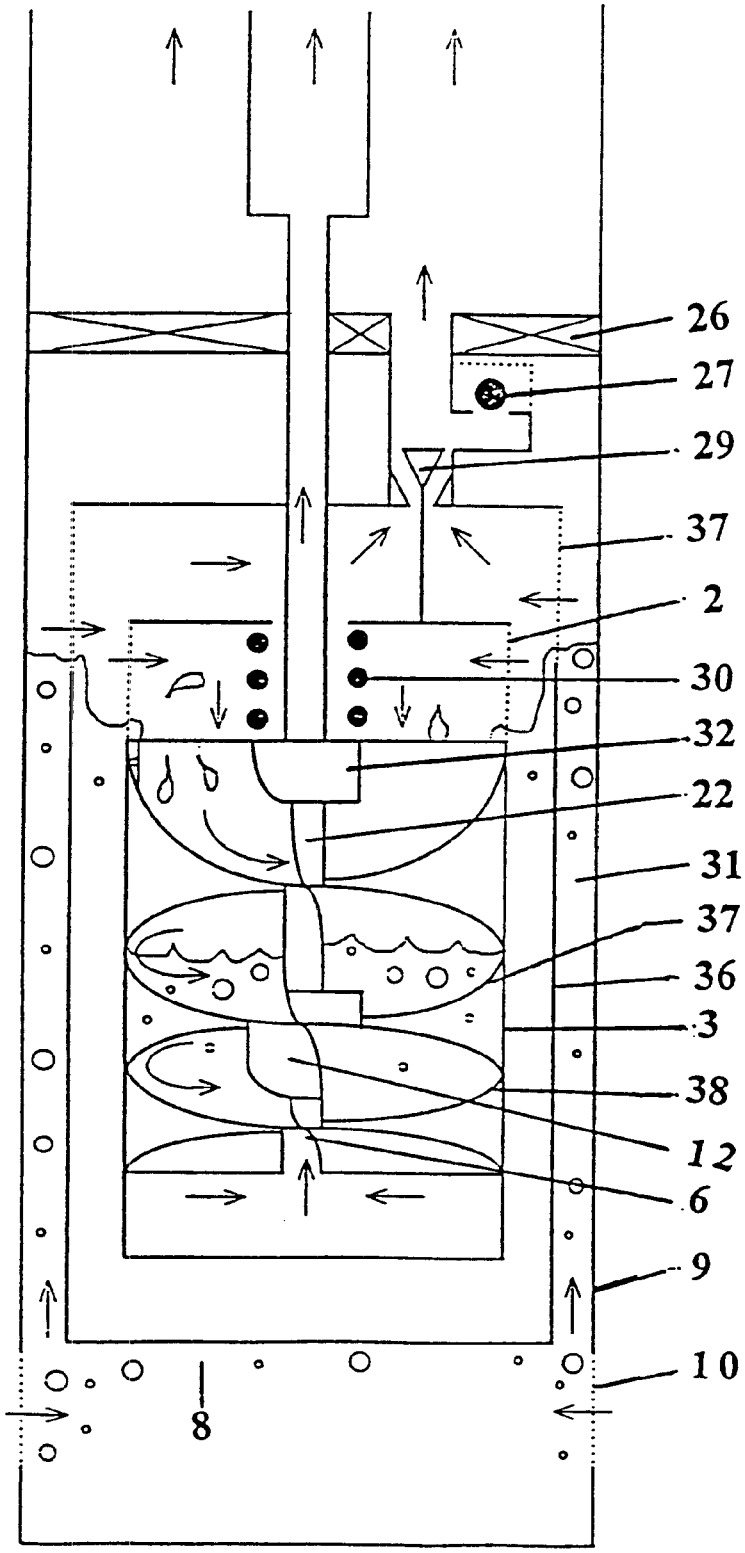
FIG. 6 shows a schematic longitudinal cross section through the gas separator according to the present invention with two helicoidal members and one double settling vessel.

In the same way as in the case of the separator of the cascade type with a single settling vessel, the separator with a double settling vessel can be provided with one or more helicoidal members. FIG. 5 shows a separator of the cascade type with a double settling vessel provided with one helicoidal member (37), and FIG. 6 shows the same equipment, but provided with two helicoidal members (37, 38). If more than two helicoidal members are used it is convenient that these should be uniformly spaced around the circumference of settling vessel (3).

Depending on the density of the fluids, the specific gravity of the separator material and the desired height of the level of liquid, there may be no need for spring (30) in the level control system in both designs (single or double settling vessel).

Both the designs have the following advantages:

- low cost of manufacture and maintenance, because they do away with the surface control system (controller, control valve, signal processor), and the level measuring system at the bottom of the well (level sensor, signal processor, electric cable),
- low manufacturing cost, because they make it possible to reduce the length of the separator,
- high separation efficiency, because they control level directly at the bottom of the well, which ensures ideal flows for separation or, that is, flow of the cascade type, or, where helicoidal members are present or when the well is directional, flows of the cascade and segregated type.

What is claimed is:

1. A separator with automatic level control to separate the gaseous phase from a two-phase liquid and gas mixture, said separator being capable of being provided at the bottom of a well provided with means for lifting liquid by pumping, said separator comprising:

- a settling vessel having a fluid entrance part in the upper portion of its side surface and which is moveable in the vertical direction;

a packer positioned above the settling vessel;

a valve arranged to control the passage of gas from the lower side of said packer to the upper side, said valve being connected to said settling vessel such that vertical movement of said settling vessel actuates said valve; and an elastic medium arranged to provide an upward force on said settling vessel.

2. A separator according to claim 1, further comprising a one-way valve which permits pressurised fluid to enter the region below said packer.

3. A separator according to claim 1, wherein said packer has a hole for the passage of a production column and a hole for the passage of a gas outlet pipe.

4. A separator according to claim 1, wherein the separator is arranged so that upward movement of said settling vessel opens said valve and downward movement of said settling vessel closes off said valve.

5. A separator according to claim 1, wherein said fluid entrance part comprises a series of holes in said settling vessel.

6. A separator according to claim 1, wherein the settling vessel has internally a helicoidal surface running from its upper portion to its lower portion.

7. A separator according to claim 1, wherein said settling vessel has two helicoidal surfaces which are about one hundred and eighty degrees out of phase.

8. A separator according to claim 1, wherein said settling vessel has more than two helicoidal surfaces equally spaced around the circumference of the settling vessel.

9. A separator according to claim 1, further comprising a fixed enclosing vessel, said settling vessel floating on a layer of liquid present within the enclosing vessel.

10. Well equipment for an oil well comprising:

a separator; with automatic level control to separate the gaseous phase from a two-phase liquid and gas mixture, said separator being capable of being provided at the bottom of a well provided with means for lifting liquid by pumping, said separator including a settling vessel having a fluid entrance part in the upper portion of its side surface and which is moveable in the vertical direction;

a packer positioned above the settling vessel; and a valve arranged to control the passage of gas from the lower side of said packer to the upper side, said valve being connected to said settling vessel such that vertical movement of said settling vessel actuates said valve;

a production column through which liquid is extracted; and a gas outlet pipe in said packer, said gas outlet pipe being connected to said valve;

wherein said settling vessel surrounds at least part of said production column and said production column is arranged to pump any liquid contained in said settling vessel.

11. Well equipment according to claim 10, wherein said gas outlet pipe links the lower chamber of the well below the packer to an annular passage of the well above the packer.

12. Well equipment according to claim 10, further comprising an elastic medium arranged to provide an upward force on said settling vessel, and wherein said elastic medium is a compression spring having a top end supporting said settling vessel via abuting the inside of the top of said settling vessel and having a bottom end supported on said production column.

13. Well equipment according to claim 10, further comprising a well casing, said well casing being fillable with fluid such that said fluid imparts a vertically upward force on said setting vessel.

14. A method of separating liquid and gas from a two-phase mixture, said method comprising:

supporting a settling vessel on a body of fluid;

allowing said two phase fluid to enter said settling vessel at its top so as to produce a cascade of fluid, thereby separating the liquid and gas phases;

collecting said separated liquid in said settling vessel;

regulating the flow of separated gas using a variable valve;

pumping said separated liquid from said settling vessel;

opening and closing off said valve in accordance with the vertical position of said settling vessel; and further comprising:

supporting said settling vessel with an elastic medium.

15. A method according to claim 14 wherein said settling vessel is supported by a body of two-phase fluid in a well casing.

16. A method according to claim 14 wherein said settling vessel is supported by a body of substantially single phase fluid in a second vessel.

17. A method according to claim 16 further comprising:

rigidly supporting said second vessel so that said settling vessel is vertically moveable therein.

18. A method according to claim 14 further comprising:

allowing said cascade of fluid to be directed by a helicoidal vane so as to impart a helical motion to said fluid and further encourage gas/liquid separation.

19. A method according to claim 17, further comprising:

opening a one-way valve to allow pressurised fluid to enter the region surround said settling vessel or said second vessel.

20. A separator with automatic level control to separate the gaseous phase from a two-phase liquid and gas mixture, said separator being capable of being provided at the bottom of a well provided with means for lifting liquid by pumping, said separator comprising:

a settling vessel having a fluid entrance part in the upper portion of its side surface and which is moveable in the vertical direction;

a packer positioned above the settling vessel; and a valve arranged to control the passage of gas from the lower side of said packer to the upper side, said valve being connected to said settling vessel such that vertical movement of said settling vessel actuates said valve;

wherein said packer has a hole for the passage of a production column and a hole for the passage of a gas outlet pipe.

21. A separator with automatic level control to separate the gaseous phase from a two-phase liquid and gas mixture, said separator being capable of being provided at the bottom of a well provided with means for lifting liquid by pumping, said separator comprising:

a settling vessel having a fluid entrance part in the upper portion of its side surface and which is moveable in the vertical direction;

a packer positioned above the settling vessel; and a valve arranged to control the passage of gas from the lower side of said packer to the upper side, said valve being connected to said settling vessel such that vertical movement of said settling vessel actuates said valve;

wherein the separator is arranged so that upward movement of said settling vessel opens said valve and downward movement of said settling vessel closes off said valve.

22. A separator with automatic level control to separate the gaseous phase from a two-phase liquid and gas mixture, said separator being capable of being provided at the bottom of a well provided with means for lifting liquid by pumping, said separator comprising:

a settling vessel having a fluid entrance part in the upper portion of its side surface and which is moveable in the vertical direction;

a packer positioned above the settling vessel; and a valve arranged to control the passage of gas from the lower side of said packer to the upper side, said valve being connected to said settling vessel such that vertical movement of said settling vessel actuates said valve;

wherein said fluid entrance part comprises a series of holes in said settling vessel.

* * * * *